United States Patent [19]

Wernicki

[11] 4,398,366

[45] Aug. 16, 1983

[54] GUN LOCK

[76] Inventor: John J. Wernicki, 22 E. Gouverneur Ave., Rutherford, N.J. 07070

[21] Appl. No.: 318,609

[22] Filed: Nov. 5, 1981

[51] Int. Cl.[3] ..... F41C 27/00

[52] U.S. Cl. ..... 42/1 LP

[58] Field of Search ..... 42/1 LP, 1 N, 70 R; 5/451

[56] References Cited

U.S. PATENT DOCUMENTS

| | | | |
|---|---|---|---|
| 2,327,334 | 8/1943 | Parker | 42/1 LP |
| 2,479,107 | 8/1949 | Garretson | 42/1 LP |
| 3,022,598 | 2/1962 | Wikstrom | 42/1 LP |
| 3,720,014 | 3/1973 | Goodrich | 42/1 LP |
| 3,768,189 | 10/1973 | Goodrich | 42/1 LP |

*Primary Examiner*—Charles T. Jordan

*Attorney, Agent, or Firm*—Arthur L. Lessler

[57] ABSTRACT

A gun lock consisting of three parts which engage each other to provide a shaft extending through the gun barrel and the bullet chamber, the shaft being held in position by means of a combination lock. A dummy round occupies the bullet chamber and has a hollow cylindrical front portion with a groove for engaging the locking balls which are disposed on the inner end of an intermediate rod which extends through the bore of the gun barrel. The intermediate rod has a slideably moveable central actuator with a cam end portion for forcing the locking balls radially outward to engage the groove of the dummy round, and semi-circular recesses into which the locking balls can fall when the actuator is pushed in to permit insertion or removal of the intermediate rod. The combination lock secures the actuator to prevent it from being moved inward to release the intermediate member from the dummy round.

7 Claims, 5 Drawing Figures

GUN LOCK

BACKGROUND OF THE INVENTION

This invention relates to a barrel type lock for guns, and is particularly suitable for use with revolvers, but not limited thereto.

Various types of gun locks are presently known, as exemplified by U.S. Pat. Nos. 3,768,189; 3,360,880; 3,720,014; 3,022,598; 3,708,901; and 2,836,918.

Of these patents, U.S. Pat. No. 3,022,598 to Wikstrom shows a three piece arrangement comprising a dummy round 18, a locking bar 14, and a lock or clip 16 which extends through a hole in the end of the bar 14. The bar 14 has a T-shaped end which is engaged with the dummy round 18 by inserting it through the rectangular hole 20, subsequently rotating the bar 90 degrees, and then pulling the bar toward the open end of the barrel, in which position it is maintained by the lock 16.

This arrangement, however, requires insertion of the bar 14 in a particular orientation with respect to the dummy round, and subsequent rotation of the bar through a 90 degree angle.

U.S. Pat. No. 3,768,189 to Goodrich accomplishes locking of a member inserted into a gun barrel by pulling the inner shaft 20 toward the open end of the barrel, so that the solid enlarged end 34 of the shaft axially compresses the resilient expandable sleeve 24 to cause it to frictionally engage the gun barrel and thus prevent removal of the locking assembly.

This arrangement, however, relies upon friction to provide the desired locking action, rather than a positive mechanical engagement.

U.S. Pat. No. 3,720,014 to Goodrich shows the use of a combination lock in conjunction with a bead chain to lock a plug A into the cartridge chamber of a firearm.

Accordingly, an object of the present invention is to provide an improved gun lock which is reliable, relatively inexpensive to manufacture, difficult to break, and easy to insert and remove.

SUMMARY

As herein provided, there is described a gun lock for a gun having a barrel with a bore therein and a chamber for receiving a round of ammunition in alignment with said bore, said lock comprising a dummy round dimensioned to fit in said chamber and having a hollow open forward end and locking ball receiving recess means contiguous with the wall thereof adjacent said open end; a hollow intermediate rod having an axially movable actuating member therein, said rod being dimensioned to fit in said bore and having an outer end and an opposite inner end, said inner end having at least two locking balls therein and means for permitting said balls to move radially between (i) a free position wherein said balls are disposed within said rod and (ii) a locking position wherein said balls extend from the surface of said rod, while restricting the axial movement of said balls, said actuating member having a lock-engaging portion adjacent said outer end of said intermediate rod, and means adjacent the inner end of said rod for engaging said locking balls to (i) urge said balls toward the locking position thereof when said lock-engaging portion of said actuating member is moved away from said inner end of said rod, and (ii) permit said balls to return to the free position thereof when said lock-engaging portion of said actuating member moves toward said inner end of said rod, said inner end of said rod being dimensioned to fit in said open end of said dummy round so that said balls engage said locking ball receiving recess means in the locking position thereof; and locking means abutting said outer end of said intermediate rod for detachably engaging said lock-engaging portion of said actuating member, to prevent axial movement thereof toward the inner end of said intermediate rod, thus insuring that said balls remain in locking engagement with said locking ball receiving recess means of said dummy round, whereby said gun lock occupies said chamber and bore to immobilize said chamber and insure there is no live round therein.

IN THE DRAWING

DETAILED DESCRIPTION

Figure 1:
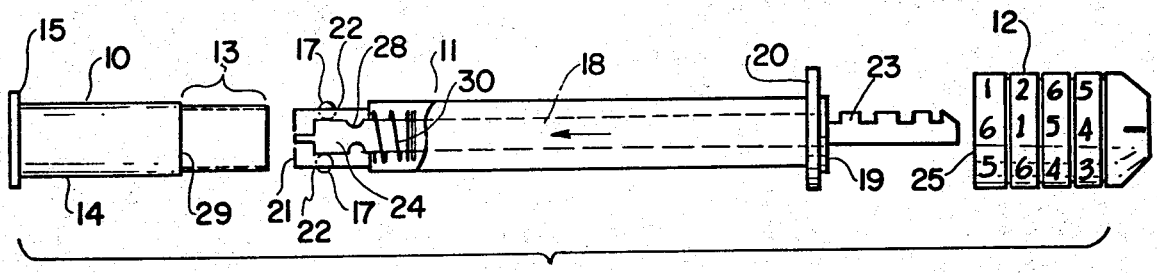
FIG. 1 shows a gun lock according to a first embodiment of the invention, prior to installation.

As shown in FIG. 1, the three parts comprising the gun lock of the present invention are a dummy round rear member 10, a hollow intermediate rod 11, and a combination lock 12, which are adapted to detachably engage each other so that the resulting structure cannot be removed from the gun in which it is installed, without first opening the lock 12.

The dummy round 10 has a hollow front end 13, a cylindrical outer surface 14 dimensioned to closely fit the cartridge or ammunition receiving chamber of a revolver or other gun, and a flange 15 to restrain forward movement of the dummy round 10.

Figure 4:
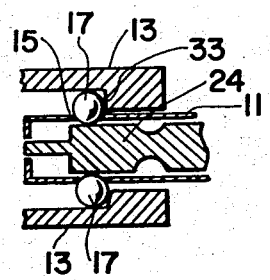
FIG. 4 is an enlarged cross-sectional view showing the locking engagement of adjacent members of the gun lock shown in FIGS. 1 to 3.

As best shown in FIG. 4, the forward end 13 of the dummy round 10 has a locking ball receiving recess means 15 in the form of a circumferential groove, i.e. a relieved area in the inner wall thereof, having a locking ball restraining shoulder 33. Alternatively, the locking ball receiving recess means of the end 13 of the dummy round 10 may comprise a raised ridge, with the shoulder 33 comprising the inner side of the ridge.

Preferably, the shoulder 33 is nearly perpendicular to the longitudinal axis of the dummy round 10, but is slightly inclined toward the open end thereof to form a ramp which provides a camming action to urge the locking balls 17 into the intermediate rod 11 when said rod is moved away from the dummy round 10.

Figure 2:
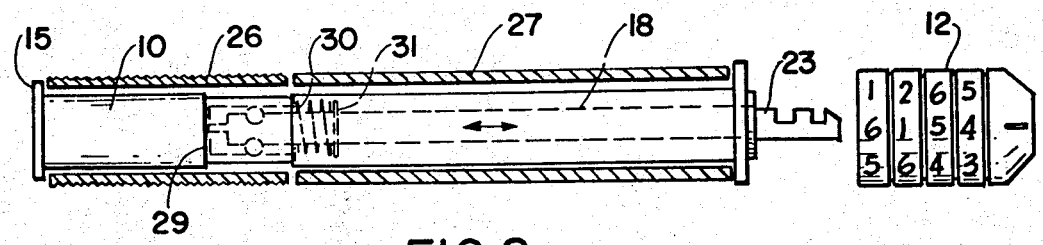
FIG. 2 shows the gun lock of FIG. 1, at an intermediate stage of installation.
Figure 3:
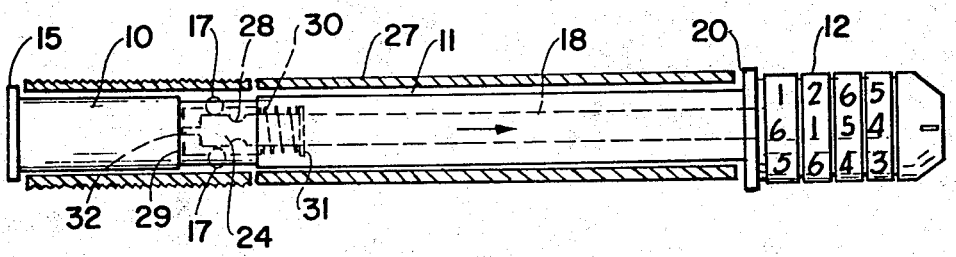
FIG. 3 shows the gun lock of FIG. 1, in the installed position.

The intermediate rod 11 has an axially movable elongated actuating member 18 therein, and the cylindrical outer surface of the intermediate rod 11 is dimensioned to fit within the bore of the gun in which the lock is to be installed. The intermediate rod 11 has an open outer end 19 with an adjacent radially outwardly extending flange 20, and an inner end 21, which inner end has at least two locking balls 17 therein and corresponding holes 22 for permitting the locking balls 17 to move radially between (i) a free position (as shown in FIG. 2) wherein the balls 17 are disposed within the rod 11 and (ii) a locking position (as shown in FIGS. 1 and 3) wherein the balls 17 extend from the surface of the rod 11. The holes 22 restrain the balls 17 against axial movement with respect to the rod 11.

The actuating member 18 has a lock-engaging portion 23 extending from the outer end 19 of the intermediate rod 11. The opposite end of the actuating member 18 has a cam portion 24 adjacent the inner end 21 of the rod 11, for engaging the locking balls 17 to (i) urge the balls 17 toward the locking position thereof (as shown in FIGS. 1 and 3) when the lock-engaging portion 23 of the actuating member 18 is moved away from the inner end of rod 11 (i.e. toward the right in FIG. 1); and (ii) permit the balls 17 to return to the free position thereof (as shown in FIG. 2) when the lock-engaging portion 23 of the actuating member 18 moves toward the inner end 21 of the rod 11 (i.e. to the left in FIG. 1).

The outer diameter of the rod 11 adjacent to the inner end 21 thereof is selected to permit the same to fit in the open end 13 of the dummy round 10 sufficiently closely so that the locking balls 17 can abut the shoulder 33 of the recess 15 in locking engagement.

The combination lock 12 is of conventional construction, and is adapted to lock by being positioned on the lock-engaging portion 23 of the actuating member 18 and changed to a combination different from that required to open the lock, by rotation of one or more of the rings thereof; and to be detachable therefrom only when the rings of the lock 12 are rotated to positions corresponding to the combination required to open the lock. Alternatively, a key-operated lock may be employed.

When the lock 12 is engaged with the portion 23 of the actuating member 18, the end 25 thereof abuts the flange 20 and the lock 12 surrounds the lock-engaging portion 23, so that the actuating member 18 is prevented from moving toward the inner end 21 of the rod 11, i.e. to the left in FIG. 1.

Figure 5:
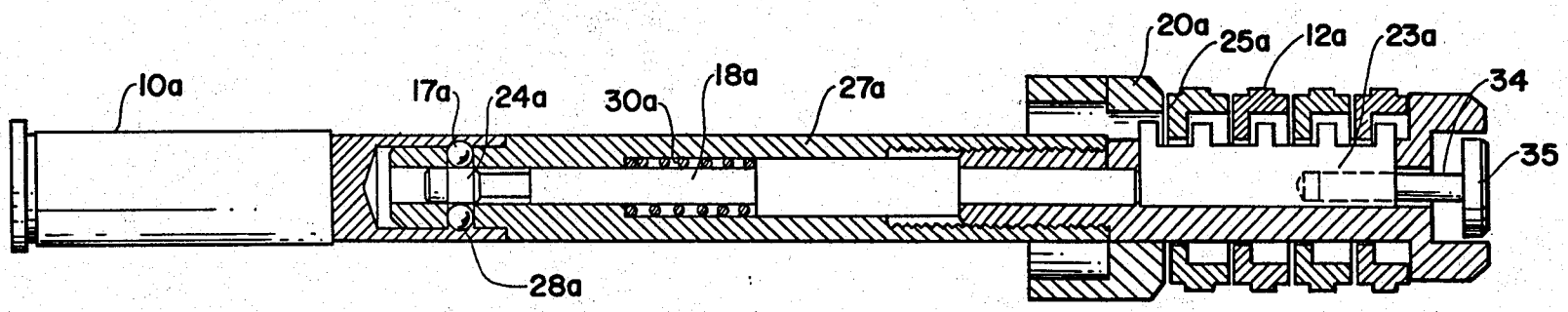
FIG. 5 shows a gun lock according to an alternative embodiment of the invention.

Alternatively, as shown in FIG. 5, the lock 12*a* may be permanently affixed to the flange 20*a* and have an axial through hole for receiving the lock-engaging portion 23*a* so that the actuating member may be depressed (when the lock 12*a* is in its unlocked condition) by pushing on the portion 23*a* thereof via the button 35 through the open end 34 of the through hole in the lock 12*a*. In FIG. 5 elements similar to those of FIGS. 1 to 4 are identified with the same numerals followed by the letter "a".

Thus, as shown in FIG. 3, the dummy round 10 and intermediate rod 11 are locked together by engagement of the locking balls 17 with the shoulder 33; and the flange 15 prevents forward movement of the interlocked assembly through the gun, while the flange 20 prevents rearward movement of said assembly.

The manner in which the lock is installed in a gun such as a revolver, will be best understood by reference to FIGS. 2 and 3 of the drawing.

First the dummy round 10 is inserted into the ammunition-receiving chamber 26 of the gun (not shown). In the event the gun is a revolver, the dummy round 10 is inserted in that chamber which is aligned with the bore of the gun barrel 27. The dummy round 10 is pushed into place until the flange 15 thereof abuts the wall of the chamber 26 to restrict further movement of the dummy round.

Then the lock-engaging portion 23 of the actuating member 18 of the intermediate rod 11 is pressed in to move the cam portion 24 of said actuating member to the left until the balls 17 fall into the circumferential recess 28 thereof. The intermediate rod 11 is then inserted in the bore of the barrel 27 until the end 21 thereof abuts the end wall 29 of the dummy round 10 defining the end of the hollow portion 13 thereof. At this point the balls 17 are in radial alignment with the groove 15, as shown in FIG. 2.

The locking portion 23 of the actuating member 18 is then released, and the compression spring 30 exerts force on the flange 31 affixed to the actuating member 18, to urge the actuating member 18 toward the end 19 of the intermediate rod 11, so that the cam portion 24 of the actuating member 18 urges the balls 17 radially outward, i.e. into locking engagement with the groove 15 (FIG. 4).

The dummy round 10 and intermediate rod 11 are thereby joined in locking engagement by means of the balls 17, as shown in FIG. 3, and movement of the assembly to the left is prevented by engagement of the flange 20 with the barrel 27.

Then the lock 12 is engaged with the locking portion 23 of the actuating member 18, so that said actuating member cannot be moved to the left to release the locking engagement between the balls 17 and the dummy round 10.

To remove the locking assembly, the combination lock 12 is first disengaged with the locking portion 23 of the actuating member 18. Then the locking portion 23 is pressed in until the end portion 32 of the actuating member 18 abuts the wall 29 and the balls 17 are free to enter the peripheral groove 28. The intermediate rod 11 is then removed through the open end of the barrel 27, and the dummy round 10 is subsequently removed from the chamber 26.

I claim:

1. A gun lock for a gun having a barrel with a generally cylindrical bore therein and a generally cylindrical chamber for receiving a round of ammunition in alignment with said bore, said lock comprising:

a dummy round rear member dimensioned to fit in said chamber, said rear member having a hollow open forward end and locking ball receiving recess means contiguous with the wall thereof adjacent said open end;

a hollow intermediate rod having an axially movable elongated actuating member therein, said rod being dimensioned to fit in said bore and having an open outer end and an opposite inner end, said inner end having at least two locking balls therein and hole means for permitting said balls to move radially between (i) a free position wherein said balls are disposed within said rod and (ii) a locking position wherein said balls extend from the surface of said rod, while restraining said balls against axial movement with respect to said rod, said actuating member having a lock-engaging portion extending from said outer end of said intermediate rod, and a cam portion adjacent the inner end of said rod for engaging said locking balls to (i) urge said balls toward the locking position thereof when said lock-engaging portion of said actuating member is moved away from said inner end of said rod, and (ii) permit said balls to return to the free position thereof when said lock-engaging portion of said actuating member moves toward said inner end of said rod, said inner end of said rod being dimensioned to closely fit in said open end of said rear member so that said balls engage said locking ball receiving recess means in the locking position thereof; and a lock abutting said outer end of said intermediate rod for detachably engaging said lock-engaging portion of said actuating member, to prevent axial movement thereof toward the inner end of said intermediate rod, thus insuring that said balls remain in locking engagement with said locking ball receiving recess means of said rear member, whereby said gun lock occupies said chamber and bore to immobilize said chamber and insure there is no live round therein.

2. The gun lock according to claim 1, further comprising spring means within said intermediate rod for urging said actuating member away from the inner end of said intermediate rod.

3. The gun lock according to claim 1, wherein said locking ball receiving recess means comprises a circumferential groove in the inner wall of the open end of said rear member.

4. The gun lock according to claim 3, wherein said groove has a shoulder for abutting said locking balls, said shoulder being nearly perpendicular to the longitudinal axis of said rear member and inclined toward the open end thereof.

5. The gun lock according to claim 1, wherein said intermediate rod has a radially outwardly extending flange adjacent the outer end thereof.

6. The gun lock according to claim 1, wherein said lock is permanently affixed to said outer end of said intermediate rod and has an axial through hole for receiving said lock-engaging portion of said actuating member so that the end of said lock-engaging portion may be depressed via said through hole.

7. A gun lock for a gun having a barrel with a bore therein and a chamber for receiving a round of ammunition in alignment with said bore, said lock comprising:

a dummy round dimensioned to fit in said chamber and having a hollow open forward end and locking ball receiving recess means contiguous with the wall thereof adjacent said open end;

a hollow intermediate rod having an axially movable actuating member therein, said rod being dimensioned to fit in said bore and having an outer end and an opposite inner end, said inner end having at least two locking balls therein and means for permitting said balls to move radially between (i) a free position wherein said balls are disposed within said rod and (ii) a locking position wherein said balls extend from the surface of said rod, while restricting the axial movement of said balls, said actuating member having a lock-engaging portion adjacent said outer end of said intermediate rod, and means adjacent the inner end of said rod for engaging said locking balls to (i) urge said balls toward the locking position thereof when said lock-engaging portion of said actuating member is moved away from said inner end of said rod, and (ii) permit said balls to return to the free position thereof when said lock-engaging portion of said actuating member moves toward said inner end of sad rod, said inner end of said rod being dimensioned to fit in said open end of said dummy round so that said balls engage said locking ball receiving recess means in the locking position thereof; and locking means abutting said outer end of said intermediate rod for detachably engaging said lock-engaging portion of said actuating member, to prevent axial movement thereof toward the inner end of said intermediate rod, thus insuring that said balls remain in locking engagement with said locking ball receiving recess means of said dummy round, whereby said gun lock occupies said chamber and bore to immobilize said chamber and insure there is no live round therein.

* * * * *